United States Patent [19]

Rivers

[11] Patent Number: 4,866,871

[45] Date of Patent: Sep. 19, 1989

[54] GUN CLEANER

[76] Inventor: Roy W. Rivers, 840 W. Lake Rd., Geneseo, N.Y. 14454

[21] Appl. No.: 230,060

[22] Filed: Aug. 9, 1988

[51] Int. Cl.[4] ..... F41C 31/00

[52] U.S. Cl. ..... 42/95; 15/104.16

[58] Field of Search ..... 42/95, 96; 15/104.05, 15/104.16, 104.165, 104.2

[56] References Cited

U.S. PATENT DOCUMENTS

| | | | |
|---|---|---|---|
| 937,729 | 10/1909 | Upham | 15/104.2 |
| 1,499,460 | 7/1924 | Kennedy | 42/95 |
| 2,744,275 | 5/1956 | Geltner | 15/104.2 |
| 2,361,395 | 10/1944 | Gilligan | 15/104.2 |
| 2,409,916 | 10/1946 | Varcoe | 42/95 |
| 2,544,847 | 3/1951 | Malesky | 42/95 |
| 2,616,109 | 11/1952 | Gardner | 42/95 |
| 2,779,042 | 1/1957 | Benny | 15/104.165 |
| 3,445,879 | 5/1969 | Taylor | 15/104.16 |
| 3,813,802 | 6/1974 | DiProspero | 42/95 |

*Primary Examiner*—Harold J. Tudor
*Assistant Examiner*—Michael J. Carone
*Attorney, Agent, or Firm*—Cumpston & Shaw

[57] ABSTRACT

A gun cleaner has an elongated sleeve, a rod reciprocally mounted in the sleeve, a gun cleaning element attached to the rod, and mounting means attached to the sleeve for slidably guiding the rod along a major axis of the sleeve between a retracted position with the gun cleaning element at least substantially disposed within the sleeve and an extended position with the head and a portion of the rod extending outwardly from the end of the sleeve.

14 Claims, 4 Drawing Sheets

GUN CLEANER

This invention relates generally to a gun cleaner and more particularly to a device for cleaning guns in the field or n ranges that is more convenient to use than known gun cleaning devices.

The best time to clean and lubricate a pistol, shotgun, or rifle is as soon as possible after using it. This minimizes fouling and the corrosive effects of gases produced during firing.

The most commonly used gun cleaning devices employ a rod, often a telescoping rod or a segmented rod, having a gun cleaning swab brush or the like attached to one end. In use, the swab is pushed through the barrel of the gun with the rod to clean it. After the barrel of a gun has been cleaned with a wire brush, for example, it is desirable to use a swab to coat it with a thin layer of oil or other lubricant and or rust inhibitor to prevent corrosion. The cleaning heads of known gun cleaning devices become quite dirty after use. It is difficult for users of known devices to assemble/disassemble the rods and cleaning elements or to transport the cleaners without coming into contact with the dirty cleaning element. As a result, shooters often postpone cleaning firearms until they return home from the field or firing range.

Briefly stated, in accordance with a presently preferred embodiment of this invention, a gun cleaner is provided that is better suited to field use than known gun cleaners. The invention provides a more practical portable cleaner than heretofore known, facilitates one hand operation and encourages, due to its ease of use, field/range cleaning of firearms immediately after use. A gun cleaner is provided that has an elongated sleeve, a rod reciprocally mounted in the sleeve, a gun cleaning element attached to the rod, and mounting means attached to the sleeve for slidably guiding the rod along a major axis of the sleeve between a retracted position with the gun cleaning element at least substantially disposed within the sleeve and an extended position with the head and a portion of the rod extending outwardly from the end of the sleeve.

The new aspects of this invention are set forth with particularity in the appended claims. The invention itself, together with further objects and advantages thereof, may be more readily appreciated by reference to the following detailed description of the preferred embodiment of the invention, taken in connection with the accompanying drawing in which:

Figure 1:
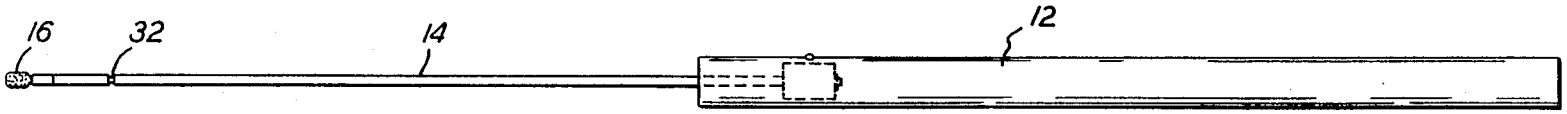
FIG. 1 is a section view of a gun cleaner in accordance with this invention with the cleaning element in its extended position.
Figure 4:
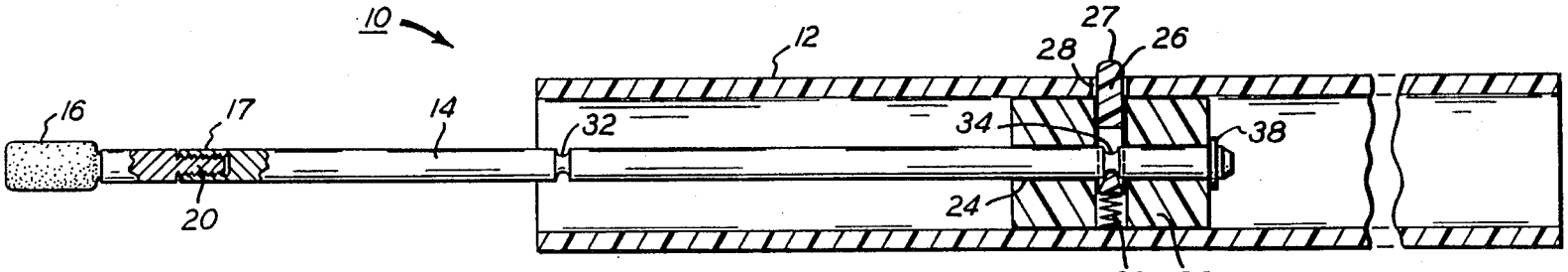
FIG. 4 is an enlarged section view of the gun cleaner of/FIG. 1 showing certain aspects thereof in more detail.

Referring now to FIGS. 1 and 4, a gun cleaner designated generally at 10 includes an elongated cylindrical sleeve 12 that is preferably made of relatively rigid plastic material, such as polyvinyl chloride (PVC) tubing or the like.

A rod 14 having a cleaning element 16 of known type attached to one end thereof is mounted within sleeve 12 for reciprocal movement. Rod 14 is preferably made of metal or any other suitable material that allows cleaning element 16 to be inserted into a gun barrel. Preferably, rod 14 has an interior threaded portion 17 at the end thereof to receive any one of a plurality of interchangeable cleaning elements 16, such as wire brushes, swabs and the like having a complementary exterior threaded portion 20.

Figure 2:
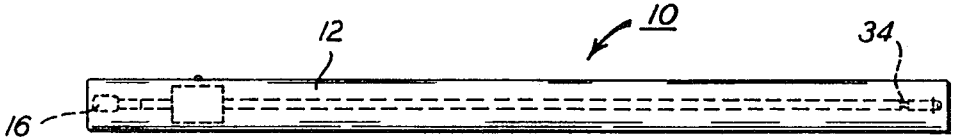
FIG. 2 is a section view of the gun cleaner of this invention with the cleaning element in its retracted position.

Rod 14 is mounted for reciprocal movement within sleeve 12 by a bushing 22. Bushing 22 has an outside diameter approximately equal to or slightly smaller than inside diameter of sleeve 12. Bushing 22 may be press fit into sleeve 12, adhesively or otherwise secured such as by a set screw, or may rely upon a release button 26 to hold the bushing in place as more fully described infra. A through bore 24 receives rod 14 in sliding engagement and maintains rod 14 in alignment with the axis of sleeve 12. Thus, in accordance with the invention, rod 14 and cleaning element 16 are movable between an extended position (FIGS. 1 and 4) in which the cleaning element and at least a portion of the rod extend beyond the end of sleeve 12, and a retracted position (FIGS. 2 and 5) in which the cleaning element 16 is at least substantially disposed within the sleeve 12. In the retracted position, the cleaning element 16 is protected by sleeve 12 from coming in contact with and soiling the clothing or hands of the user.

Figure 6:
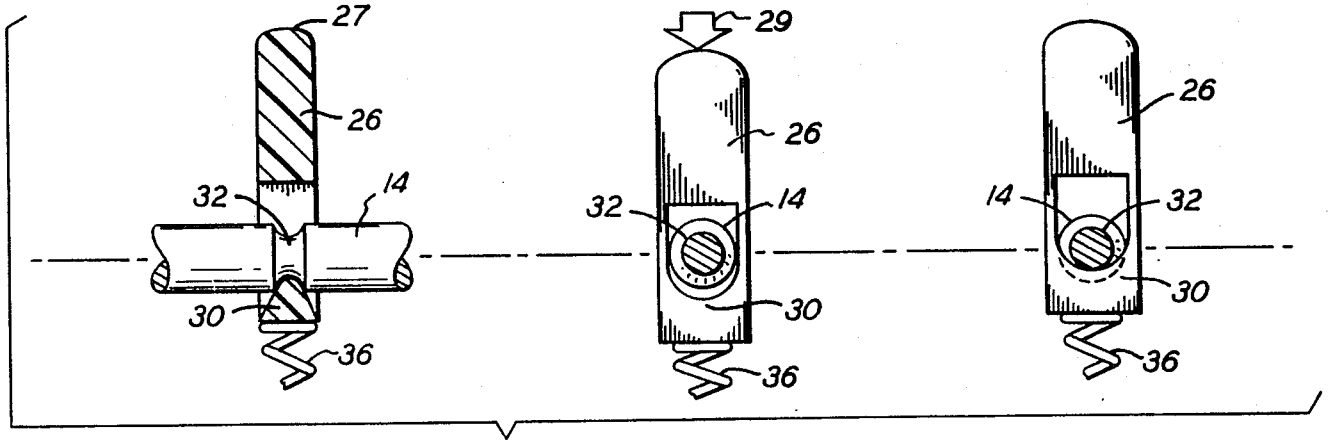
FIG. 6 is a still further enlarged detail, partly in section, of the latch mechanism of this invention.

In accordance with a preferred embodiment of this invention, a latch assembly is provided for holding the rod 14 in one of the extended and retracted positions. The details of the latch assembly are shown in FIG. 6. The latch includes a reciprocally movable button 26 having an actuating portion extending outwardly through an opening 28 in the wall of the sleeve 12. Preferably, the button 26 has a tooth 30 opposite the actuating portion that engages one of two necked down regions 32, 34 on rod 14 to fix the rod in either the extended or retracted position. A spring 36 urges the tooth into engagement with the necked down region to hold the rod in one of the extended or retracted positions. As shown in FIG. 6, to move the rod 14 from one position to the other, the actuating portion 27 of button 26 is depressed as by arrow 29 against the bias of spring 36 to displace the tooth 30 out of engagement with necked down region 32 to release the rod 14. Rod 14 is then free to slide between the positions shown in FIGS. 1 and 2. A stop such as a snap ring 38 mounted at one end of rod 14 is provided to prevent the rod from being withdrawn from bushing 22 and falling out. The cleaning element 16 and/or an enlarged portion of coupling 20 prevents the rod from passing through bushing 22 in the opposite direction. While the invention is illustrated in connection with an embodiment having two or more necked down regions, one or more of these regions may be eliminated for simplicity. It is not strictly required that the tooth 30 engage a necked down region to hold the rod on a retracted position. Where desired, friction between the tooth and the rod may provide the necessary force to hold the rod in the retracted position, relying on engagement between the tooth and a necked down region to hold the rod in the extended position only, where forces are greater.

Figure 3:
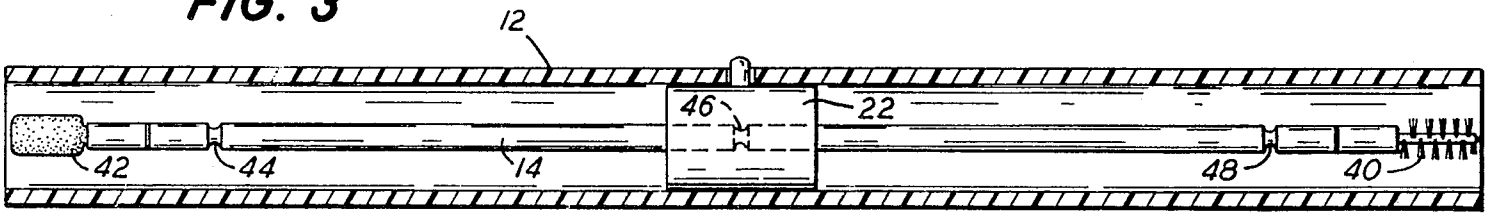
FIG. 3 is a section view of a gun cleaner in accordance with an embodiment of the invention having both a brush and a swab.
Figure 5:
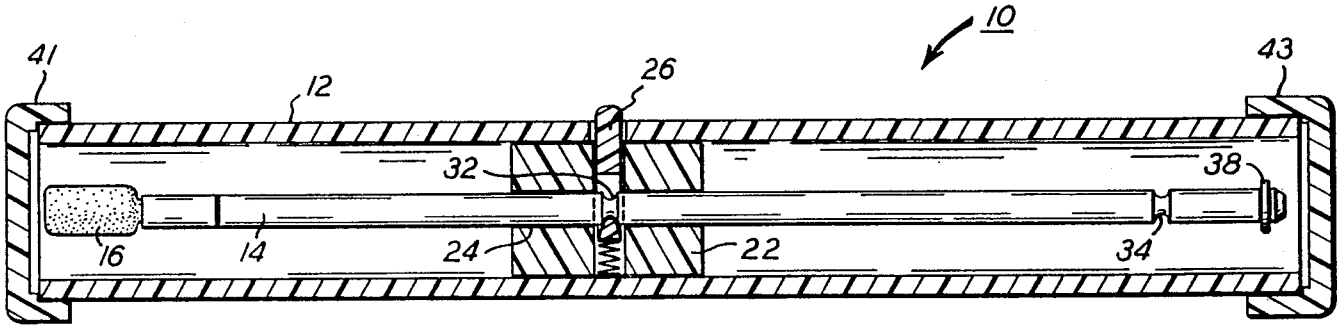
FIG. 5 is an enlarged section view of the gun cleaner of FIG. 2 showing certain elements thereof in greater detail.

In accordance with an especially simple embodiment of this invention as shown in FIG. 1, it is convenient to use the gun cleaner as follows: when not in use, the cleaner is in the retracted position as shown in FIG. 3 and may be carried by a belt loop or placing it in a deep pocket or the like; when it is desired to extend the cleaning element 16 out of the sleeve, button 26 is depressed while holding the sleeve in one hand and moving it in a whipping motion. This conveniently extends the rod and cleaning element from the sleeve. Alternatively, by merely holding the sleeve vertically, gravity will cause the rod to extend from the sleeve. Button 26 is then released and wire loop 30 engages the necked down region 34 to lock the rod and cleaning element in the extended position shown in FIG. 1. In order to avoid failure to latch due to tolerance build up, necked down region 34 may be positioned on the rod so that it normally moves slightly past the tooth to the left as shown in FIGS. 1 and 4 and engages the tooth when the cleaning head is inserted into the firearm and the rod is pushed back slightly. The gun cleaner may then be operated by grasping the sleeve as a handle and reciprocally moving the cleaning element through the barrel of the gun. When the gun cleaner is no longer needed, it can be held in a position with the cleaning element extending upwardly. Depressing the button allows the rod and cleaning element to retract into the sleeve by their own weight to the position shown in FIG. 2, in which the cleaning element is disposed substantially entirely within the sleeve, at which point the button is released and tooth 30 engages the necked down region 32 to lock the rod in the retracted position. Where necked down region 32 is not provided, the cleaning element itself limits the travel of the rod. Thus, it is never necessary for the user to physically touch either the cleaning element or the rod while cleaning a gun. Further, the cleaning element is protected within the sleeve during periods of non-use, so that it will not accidentally come into contact with the clothing of the user. Preferably, end caps 41 and 43 as shown in FIG. 5 are provided to cover the ends of the sleeve to prevent dirt from entering the sleeve or from leaving the sleeve. Where a necked down region is not provided to hold the rod in its retracted position, the end caps may fulfill this function.

Figure 7:
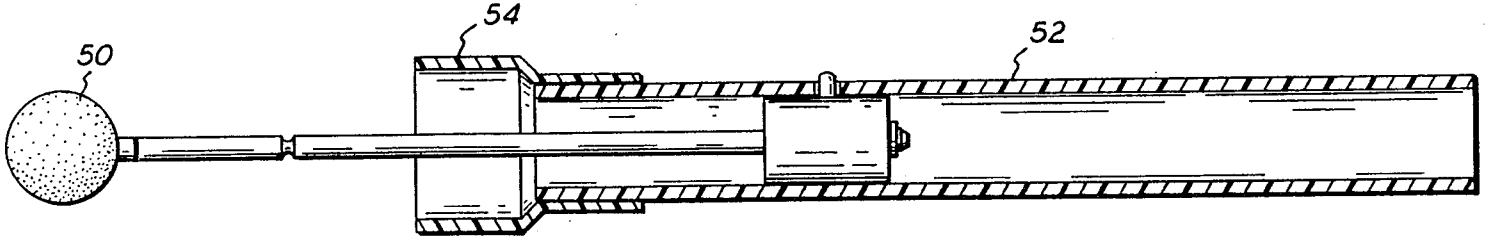
FIG. 7 is a section view of a gun cleaner in accordance with another embodiment.

An embodiment of this invention of particular utility for cleaning handgun barrels or cylinders, other firearms with short barrels, and shotgun or rifle chambers, chokes and choke tubes is illustrated at FIG. 3. Bushing 22 is positioned approximately at the center of sleeve 12 and rod 14 has a cleaning element at each end, preferably a brush 40 at one end and a swab 42 at the other end. Three necked down regions 44, 46 and 48 are provided in rod 14 to allow either of brush 40 or swab 42 to be extended from the cleaner, or to allow both to be retracted with the rod positioned approximately centrally within the cleaner. The button assembly is substantially identical to that already described in connection with FIGS. 4 and 6 and the details are omitted here for simplicity. FIG. 7 shows still another embodiment of this invention, in which a cleaning element is employed that is too large to fit within the body of sleeve 52. Sleeve 52 is enlarged at one end 54 (or both ends) to permit a large swab 50 to be received therein, but is in all other respects substantially identical to that shown in FIGS. 1, 2 and 3.

Figure 8:
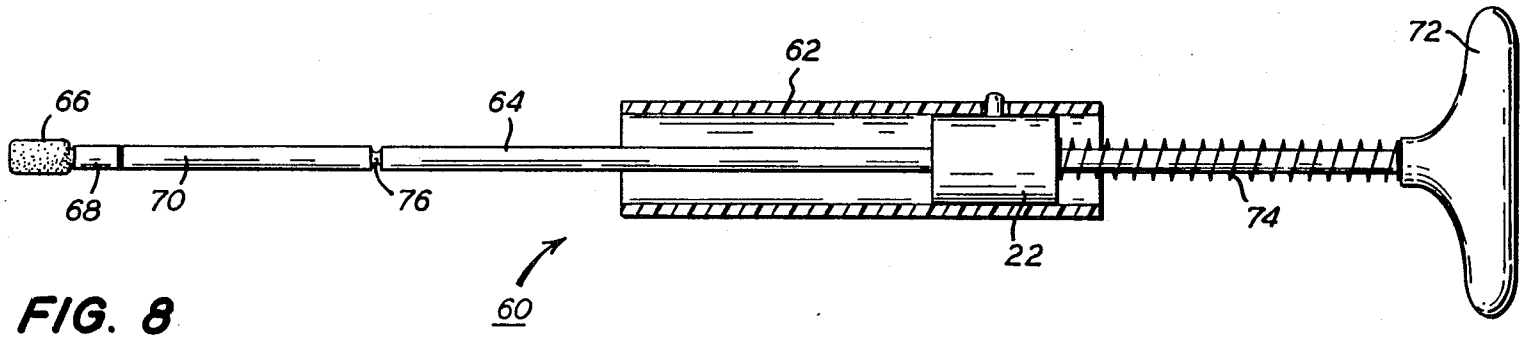
FIG. 8 is a section view of a gun cleaner with spring biased retraction in accordance with this invention.

While the preferred embodiment of this invention uses a rod that is freely reciprocally mounted in a bushing, various spring biased arrangements may also be used. For example, referring now to FIG. 8, a cleaner in accordance with another embodiment of this invention is designated generally as 60. The cleaner includes a sleeve 62 and an elongated rod 64 having a cleaning head 66 attached to one end thereof by complementary threaded portions 68 and 70. A push button release mechanism substantially as already described in connection with the embodiments of the invention illustrated in FIGS. 1 through 7 is also provided and will not be described in further detail here. Rod 64 is provided with a T handle or other conveniently shaped handle 72 at the end opposite the cleaning head 66. A coil spring 74 is disposed around rod 64 between the end of bushing 22 and handle 72. Spring 74 urges rod 64 to its retracted position. Accordingly, to clean a firearm the sleeve is held and handle 72 is pushed to compress spring 74 until rod 64 moves to its extended position and the tooth of the latch mechanism engages necked down region that is within bushing 22 as shown in FIG. 8. To retract the rod into the sleeve, button 26 is depressed and spring 74 causes the cleaning head to be retracted into the sleeve.

Figure 9:
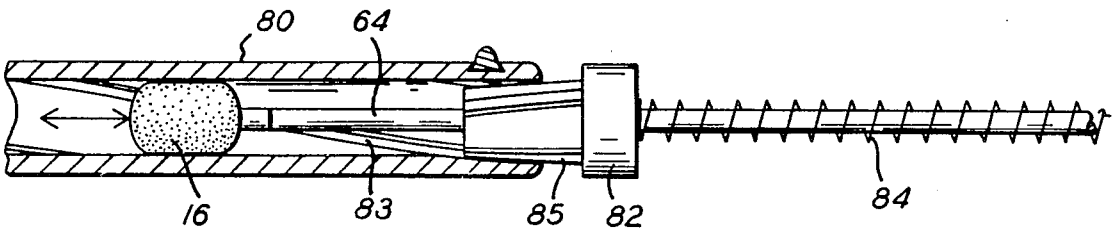
FIG. 9 is a side-elevation, partly in section, of a centering collar in accordance with this invention.

Yet another aspect of this invention is illustrated at FIG. 9. A barrel 80 on a rifle, pistol or the like is illustrated with the swab end 16 of a cleaner in accordance with this invention partially inserted therein. A centering collar 82 is slidingly disposed on rod 64 for centering the rod within the barrel. A spring 84 urges collar 82 into engagement with the end of barrel 80 as the cleaning head 66 is moved in and out of the barrel. Preferably, when the centering collar 82 is used with a barrel having a rifling groove 83, a corresponding raised portion 85 is provided on the centering collar for engaging the rifling groove. It will be understood that centering collar 82 may also be used in connection with gun cleaners of conventional design to maintain the cleaning head center within the barrel and to prevent rod 64 from inadvertently coming into contact with the end of the barrel and possibly deforming the inner surface of the barrel or the rifling grooves therein.

While the invention has been described in connection with a number of presently preferred embodiments thereof, many modifications and changes will be apparent to those skilled in the art that do not depart from the true spirit and scope of the invention. For example, a flexible rod may be substituted for the rigid rod shown to allow the gun cleaner to be used in cleaning the chambers of autoloading and pump action shotguns that cannot be reached with a straight rod.

Accordingly, it is intended that these and other embodiments of the invention that will occur to those skilled in the art are encompassed within the scope of the following claims.

What is claimed is:

1. A gun cleaner comprising:

a gun cleaning element;

a rod supporting said gun cleaning element for reciprocal movement through a gun to be cleaned;

a protective sleeve for covering said gun cleaning element when not in use;

bushing means for slidably mounting said rod in said sleeve in an extended position in which said gun cleaning element and at least a portion of said rod extend beyond an end of said sleeve, said sleeve serving as a handle for said gun cleaner and a retracted position in which said cleaning element is substantially within said sleeve.

2. The gun cleaner of claim 1 further comprising latch means for fixing said rod in one of said extended and retracted positions.

3. The gun cleaner of claim 2 wherein said latching means comprises means on said rod and complementary means carried on said sleeve for selectively fixedly engaging said means on said rod.

4. The gun cleaner of claim 3 wherein said means on said rod comprises a necked down region and said complementary means comprises a tooth engaging said necked down region.

5. The gun cleaner of claim 4 wherein said member comprises a reciprocally movable button means carried by said bushing and extending outwardly from said sleeve for manual engagement.

6. The gun cleaner of claim 5 wherein said button means is a plunger.

7. The gun cleaner of claim 6 wherein said plunger is spring biased into a position wherein said tooth means engages said necked down region.

8. The gun cleaner of claim 1 wherein said sleeve is characterized by a diameter smaller than the diameter of said cleaning element and further comprising an extension on said sleeve having a larger diameter sufficient to receive said cleaning element.

9. The gun cleaner of claim 1 further comprising a second cleaning element supported by said rod at another end of said rod.

10. The gun cleaner of claim 9 wherein said rod is movable along three positions;

a first position with said cleaning element is extending beyond said sleeve and said second cleaning element is retracted within said sleeve;

a second position in which said second cleaning element is extended and said first cleaning element is retracted; and a third position in which said first and second cleaning elements are both disposed within said sleeve.

11. The gun cleaner of claim 1 further comprising means for biasing said rod to said retracted position.

12. The gun cleaner of claim 11 further comprising a handle on an end of said rod opposite said cleaning element, and wherein said biasing means comprises a coil spring disposed between said handle and said bushing means.

13. A gun cleaner for cleaning the barrel of a gun having an inside diameter d and a rifling groove comprising a rod movable within said barrel;

a cleaning element attached to an end of said rod;

a centering collar slidably mounted on said rod and having a first end, at least a portion of which has a diameter smaller than said diameter d for fitting within the end of said barrel at least one raised portion for matingly engaging said rifling groove;

a second end having a diameter larger than said diameter d; and spring means mounted on said rod opposite said cleaning element for biasing said collar into engagement with the end of said barrel, whereby said rod is prevented from contacting the inside surface of said barrel.

14. The gun cleaner of claim 13 wherein said centering collar is tapered.

* * * * *